US009444195B1

(12) United States Patent
Wang

(10) Patent No.: US 9,444,195 B1
(45) Date of Patent: Sep. 13, 2016

(54) PCIE-OCULINK CABLE END CONNECTOR

(71) Applicant: Amphenol East Asia Electronic Technology (Shen Zhen) Co., Ltd., Shenzhen (CN)

(72) Inventor: Xiang Wang, Shenzhen (CN)

(73) Assignee: Amphenol East Asia Electronic Technology (Shen Zhen) Co., Ltd., Shenzhen (CN)

( * ) Notice: Subject to any disclaimer, the term of this patent is extended or adjusted under 35 U.S.C. 154(b) by 0 days.

(21) Appl. No.: 14/937,099

(22) Filed: Nov. 10, 2015

(51) Int. Cl.

| | |
|---|---|
| ***H01R 24/00*** | (2011.01) |
| ***H01R 33/00*** | (2006.01) |
| ***H01R 13/66*** | (2006.01) |
| ***H01R 13/42*** | (2006.01) |

(52) U.S. Cl.
CPC ..... *H01R 13/665* (2013.01); *H01R 13/42* (2013.01)

(58) Field of Classification Search
CPC ..... H01R 23/02; H01R 24/60; H01R 24/62; H01R 24/78; H01R 13/648; H01R 13/658; H01R 13/6581; H01R 13/6585; H01R 13/6586
USPC ..... 439/660, 607.01, 607.05, 607.35, 607.4
See application file for complete search history.

(56) References Cited

U.S. PATENT DOCUMENTS

| | | | | |
|---|---|---|---|---|
| 8,066,532 | B2 * | 11/2011 | Hou | H01R 13/6658 439/660 |
| 8,197,281 | B2 * | 6/2012 | Yang | H01R 4/023 439/499 |
| 9,214,766 | B1 * | 12/2015 | Yu | H01R 13/6585 |
| 9,287,668 | B2 * | 3/2016 | Chen | H01R 13/6658 |
| 9,356,406 | B2 * | 5/2016 | Yen | H01R 13/6585 |
| 2015/0214651 | A1 * | 7/2015 | Qi | H01R 13/6658 439/676 |
| 2016/0134059 | A1 * | 5/2016 | Deng | H01R 13/6581 439/607.01 |

* cited by examiner

*Primary Examiner* — Hae Moon Hyeon
(74) *Attorney, Agent, or Firm* — Maier & Maier, PLLC

(57) ABSTRACT

The new PCIE-OCuLink cable end connector can include terminals, a plastic part, a rear cover, an iron shell and a PCB. These terminals are divided into two groups. Each of the two groups snaps onto one and the other side of the plastic part symmetrically, forming an assembly. The rear cover is snapped into firm connection with the iron shell such that the assembly is accommodated within the interior space formed by them. The PCB and the rear ends of the terminals mate and insert with each other. With the two side pieces wrapping their middle portions, the terminals are pressed into the main body, and each side piece is tightly clamped within a respective clamping groove at the same time. Each terminal includes a root portion.

1 Claim, 3 Drawing Sheets

PCIE-OCULINK CABLE END CONNECTOR

TECHNICAL FIELD

The present application relates to the field of connector, particularly to a new PCIE-OCuLink cable end connector.

BACKGROUND

Currently, the demands on dimension and cost of Peripheral Component Interconnect Express (PCIE) connector become increasingly high in the PCIE market, resulting in the development of Peripheral Component Interconnect Express-Optical Copper Link (PCIE-OCuLink) cable end connector. This kind of connector is specifically designed for applications within PCI-E or that of peripheral equipment, for example standard products such as data lines etc. This connector is capable of achieving an initial data transmission rate of 8 Gbps (1 GB/S), which has been improved into a PCIE-OCuLink cable end connector with four channels and a one-way data transmission rate up to 16 Gbps.

At present, there remains space to improve the structure of this product, including improving the terminal retaining capability and the pulling-off force of the cable end as well as making the outer shapes of the connector smaller and so on, thereby rendering a more sophisticated and cheaper product while ensuring a higher transmission rate.

SUMMARY

In order to solve the above mentioned technical problems, the present application provides a new PCIE-OCuLink cable end connector with an optimized structure which enhances the terminal retaining capability and the pulling-off force of the cable end and makes the outer dimensions of the connector smaller.

In order to solve the above discussed problems, the present application particularly provides the following technical solution.

A new PCIE-OCuLink cable end connector comprises terminals, a plastic part, a rear cover, an iron shell and a PCB.

These terminals are divided into two groups. Each of the two groups snaps onto one and the other side of the plastic part symmetrically, forming an assembly. The rear cover is snapped into firm connection with the iron shell such that the assembly is accommodated within the interior space formed by them. The PCB and the rear ends of the terminals mate and insert with each other.

The plastic part includes a main body and two side pieces. The rear end of the main body is clamped within the back cover. The main body includes two clamping grooves, respectively located on two opposing sides of the rear end of the plastic part. With the two side pieces wrapping their middle portions, the terminals are pressed into the main body, and each side piece is tightly clamped within a respective clamping groove at the same time. Each terminal includes a root portion. After the terminals being pressed into the main body, each of the two groups of terminals is supported by the clamping grooves, making the root portions parallel with each other.

The rear cover includes at least one male snap which is disposed on the outer side of the rear cover. The iron shell includes at least one female snap which is disposed on the outer side of the iron shell. When the rear cover is clamped securely with the iron shell, each male snap is snapped into a respective female snap.

With the above mentioned technical solutions, the present invention could achieve several advantageous effects. Compared with the technical solutions in the prior art, the technical solutions of the present invention have the following advantages.

By providing the plastic part, particularly the clamping grooves and the side pieces used for pressing the terminals into the main body, the terminals are supported by the clamping grooves so that the root portions of the terminals located on each side of the plastic part are parallel with each other. In other words, the above structure aids in reducing the plugging resistance of the terminals and raising the terminal retaining capability and the pulling-off force of the cable end. The side pieces themselves may also be clamped within the clamping grooves respectively, thus fixing the terminals within the main body. The rear cover and the iron shell are clamped together by snapping the male snaps into the female snaps. Accordingly, the present technical solution further enhances the robustness of the structure and reduces the size of the fastening mechanism, therefore make the outer dimensions of the connector smaller. Additionally, the back cover is also capable of keeping the weld legs of the terminals correctly oriented.

DETAILED DESCRIPTION OF THE EMBODIMENTS

Figure 1:
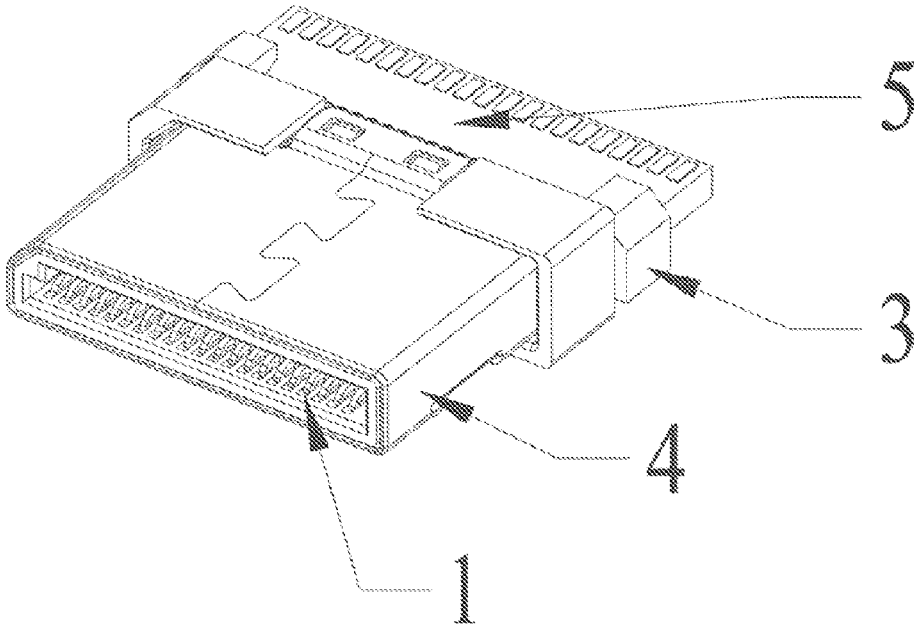
FIG. 1 is a front perspective view of a new PCIE-OCuLink cable end connector.
Figure 2:
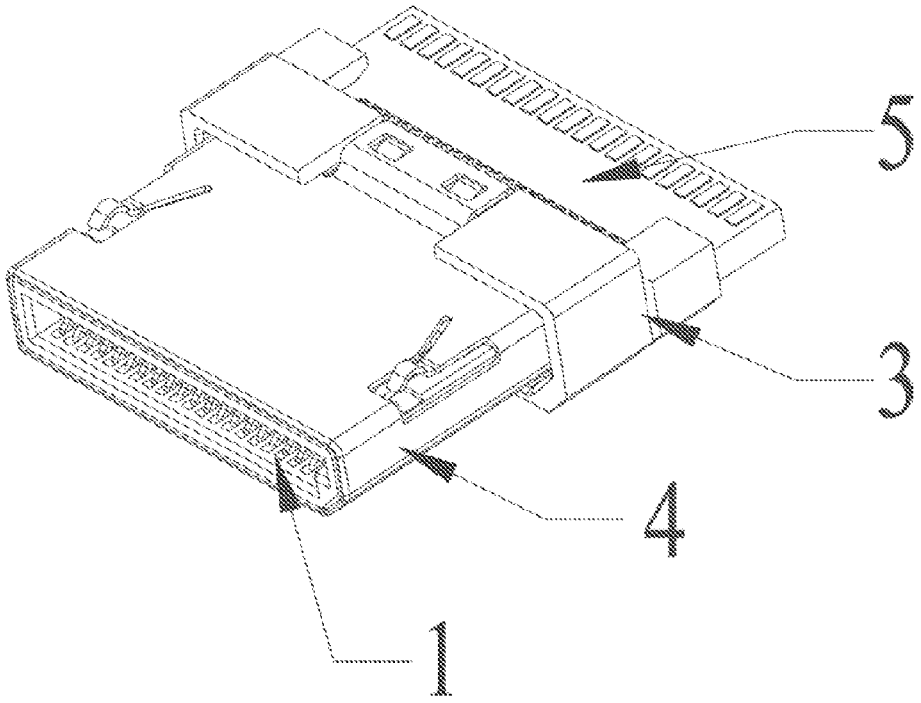
FIG. 2 is a rear perspective view of the new PCIE-OCuLink cable end connector.
Figure 3:
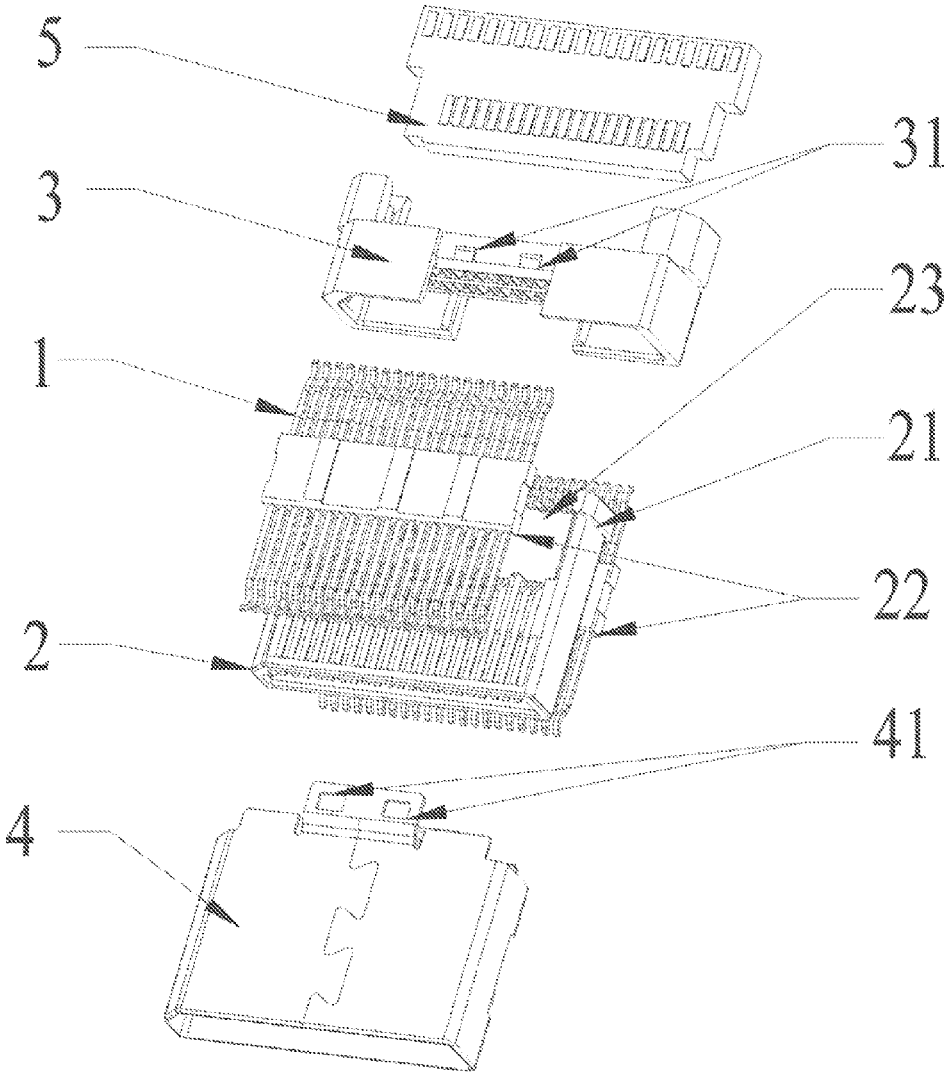
FIG. 3 is an exploded view of the new PCIE-OCuLink cable end connector.

The present invention will now be described in detail with reference to the specific embodiments, taken in conjunction with FIG. 1 to FIG. 4. However, the description and figures are not intended to limit the scope of the present application.

Embodiment 1

As shown in FIGS. 1-4, a new PCIE-OCuLink cable end connector comprises terminals 1, a plastic part 2, a rear cover 3, an iron shell 4 and a PCB 5.

These terminals 1 are divided into two groups. Each of the two groups snaps onto one and the other side of the plastic part 2 symmetrically, forming an assembly. The rear cover 3 is snapped into firm connection with the iron shell 4 such that the assembly is accommodated within the interior space formed by them. The PCB 5 and the rear ends of the terminals 1 mate and insert with each other.

The plastic part 2 includes a main body 21 and two side pieces 22. The rear end of the main body 21 is clamped within the back cover 3. The main body 21 includes two clamping grooves 23, each respectively located on one of two opposing sides of the rear end of the plastic part 2. With the two side pieces 22 wrapping their middle portions, the terminals 1 are pressed into the main body 21, and each side piece 22 is tightly clamped within a respective clamping groove 23 at the same time. Each terminal 1 includes a root portion 11. After the terminals 1 being pressed into the main body 21, each of the two groups of terminals 1 are supported by the clamping grooves 23, making the root portions 11 parallel with each other.

The rear cover 3 includes at least one male snap 31 which is disposed on the outer side of the rear cover 3. The iron shell 4 includes at least one female snap 41 which is disposed on the outer side of the iron shell 4. When the rear cover 3 is clamped securely with the iron shell 4, each male snap 31 is snapped into a respective female snap 41.

Embodiment 2

Figure 4:
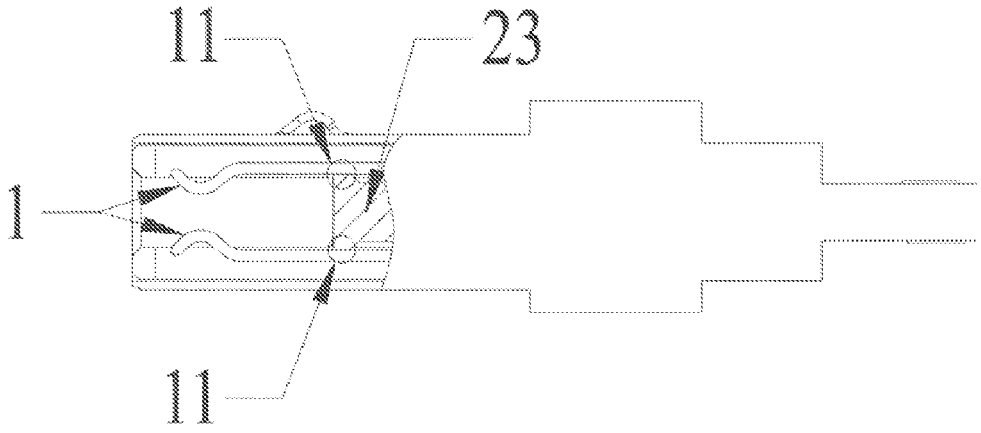
FIG. 4 is a schematic view of the new PCIE-OCuLink cable end connector, showing parallel root portions of the terminals pressed into the main body.

On the basis of the embodiment 1, as shown in FIG. 4, during the assembly of the new PCIE-OCuLink cable end connector, the root portions 11 of the terminals 1 need be pressed beforehand so as to increase the terminal retaining capability and the pulling-off force of the cable end. The specific operation includes the following steps: 1. the two side pieces 22 wrap the middle portions of the terminals 1, forming a compound. 2. The compound is pressed into the main body 21, wherein the root portions 11 are supported by the clamping grooves 23 so that the root portions 11 of the terminals 1 located on each side of the plastic part 2 are parallel with each other. 3. During the pressing process, the side pieces 22 themselves are also clamped within the clamping grooves 23 respectively, thus the terminals 1 are fixed and the root portions 11 are made parallel with each other as well.

From the common knowledge in the art, the present invention can be realized by other embodiments which do not depart from the spirit and essential features of the application. Therefore, under any circumstances, the above disclosed embodiments are intended for the purpose of illustration only, and are not intended to be exhaustive. The modifications and variations within the scope of the application or its equivalents will fall within the protection scope of the invention.

The invention claimed is:

1. A PCIE-OCuLink cable end connector comprising: terminals, a plastic part, a rear cover, an iron shell and a PCB;

wherein the terminals are divided into two groups, each group of the terminals snaps onto one and the other side of the plastic part symmetrically, forming an assembly, the rear cover is snapped into firm connection with the iron shell such that the assembly is accommodated within the interior space formed by the rear cover and the iron shell, the PCB matches and inserts into the rear ends of the terminals;

wherein the plastic part includes a main body and two side pieces, the rear end of the main body is clamped in the rear cover;

wherein the main body includes two clamping grooves, respectively located on two opposing sides of the rear end of the plastic part, the two side pieces wrap the middle portions of the terminals and the terminals are pressed into the main body, and each side piece is tightly clamped within a respective clamping groove at the same time;

wherein each terminal includes a root portion, after the terminals being pressed into the main body, each of the two groups of the terminals is supported by the clamping grooves, making the root portions parallel with each other; and;

wherein the rear cover includes at least one male snap which is disposed on the outer side of the rear cover, the iron shell includes at least one female snap which is disposed on the outer side of the iron shell; when the rear cover is clamped securely with the iron shell, each male snap is snapped into a respective female snap.

* * * * *